US010082023B2

(12) United States Patent
Khoo et al.

(10) Patent No.: US 10,082,023 B2
(45) Date of Patent: Sep. 25, 2018

(54) COMPOSITE SAMPLER AND NITROGEN BOTTLE

(71) Applicant: Halliburton Energy Services, Inc., Houston, TX (US)

(72) Inventors: Richard Teng Thuan Khoo, Gelugor Penang (MY); Adan Hernandez Herrera, Baytown, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 401 days.

(21) Appl. No.: 14/764,478

(22) PCT Filed: May 31, 2013

(86) PCT No.: PCT/US2013/043787
§ 371 (c)(1),
(2) Date: Jul. 29, 2015

(87) PCT Pub. No.: WO2014/193423
PCT Pub. Date: Dec. 4, 2014

(65) Prior Publication Data

US 2016/0069183 A1 Mar. 10, 2016

(51) Int. Cl.
*E21B 49/08* (2006.01)

(52) U.S. Cl.
CPC ..... *E21B 49/081* (2013.01); *E21B 49/086* (2013.01); *E21B 2049/085* (2013.01)

(58) Field of Classification Search
CPC ..... E21B 49/08; E21B 49/081; E21B 49/982; E21B 49/083; E21B 49/084; E21B 2049/085; E21B 49/088
See application file for complete search history.

(56) References Cited

U.S. PATENT DOCUMENTS 4,570,481 A * 2/1986 McLaurin ..... E21B 47/01 73/152.03
4,766,955 A 8/1988 Petermann
(Continued)

FOREIGN PATENT DOCUMENTS

| | | | |
|---|---|---|---|
| EP | 0911483 | A2 | 4/1999 |
| WO | 199314295 | A1 | 7/1993 |
| WO | 2012033486 | A1 | 3/2012 |

OTHER PUBLICATIONS

International Search Report dated Feb. 21, 2014 and issued in corresponding application No. PCT/US2013/043787 filed May 31, 2013, 4 pgs.

(Continued)

*Primary Examiner* — Yong-Suk Ro
(74) *Attorney, Agent, or Firm* — Chamberlain Hrdlicka

(57) ABSTRACT

An apparatus for obtaining a plurality of fluid samples in a subterranean well includes a carrier, a plurality of sampling chambers and a plurality of pressure sources. The sampling chambers and pressure sources substantially comprises non-metallic materials. One or more of the following: conductors, transducers, power sources, communicators, data memory and processors are embedded in the materials comprising the sampler apparatus. One or more transducers for measuring the temperature, pressure, and volume of the sample are present in at least one of the plurality of sampling chambers. Means for measuring the parameters of the well-bore fluid are also present in the sampler apparatus. Means for communicating measured data to the surface are provided in the sampling apparatus.

27 Claims, 9 Drawing Sheets

(56) References Cited

U.S. PATENT DOCUMENTS

| | | | | |
|---|---|---|---|---|
| 4,871,019 | A | 10/1989 | Haley et al. | |
| 5,485,881 | A | 1/1996 | Toon et al. | |
| 7,472,589 | B2 | 1/2009 | Irani et al. | |
| 2005/0274509 | A1* | 12/2005 | Breglio, III | E21B 49/081 166/169 |
| 2007/0101808 | A1* | 5/2007 | Irani | E21B 49/081 73/152.23 |
| 2008/0087470 | A1 | 4/2008 | Villareal | |
| 2008/0148838 | A1* | 6/2008 | Irani | E21B 41/00 73/152.23 |
| 2009/0166085 | A1 | 7/2009 | Ciglence et al. | |
| 2009/0241657 | A1* | 10/2009 | Irani | E21B 49/081 73/152.23 |
| 2010/0116493 | A1* | 5/2010 | Irani | E21B 49/081 166/264 |

OTHER PUBLICATIONS

Extended European Search Report issued in corresponding application No. 13886031.7 dated Nov. 4, 2016, 9 pgs.

* cited by examiner

COMPOSITE SAMPLER AND NITROGEN BOTTLE

CROSS REFERENCE TO RELATED APPLICATIONS

None.

BACKGROUND

Technical Field

This invention relates, in general, to testing and evaluation of subterranean formation fluids and, in one embodiment to a single phase fluid sampling apparatus with embedded transducers to evaluate and measure various aspects of the sampling process and to measure various parameters of the samples. The invention also relates to sampling apparatus for use in severe subterranean conditions.

Background Art

It is well known in the subterranean well drilling and completion art to perform tests on formations intersected by a wellbore. Such tests are typically performed in order to determine geological or other physical properties of the formation and fluids contained therein. For example, parameters such as permeability, porosity, fluid resistivity, temperature, pressure and bubble point may be determined. These and other characteristics of the formation and fluid contained therein may be determined by performing tests on the formation before the well is completed.

One type of testing procedure that is commonly performed is to obtain a fluid sample from the formation to, among other things, determine the composition of the formation fluids. In this procedure, it is important to obtain a sample of the formation fluid that is representative of the fluids as they exist in the formation. In a typical sampling procedure, a sample of the formation fluids may be obtained by lowering a sampling tool having a sampling chamber into the wellbore on a conveyance such as a wireline, slickline, coiled tubing, jointed tubing or the like. When the sampling tool reaches the desired depth, one or more ports are opened to allow collection of the formation fluids. The ports may be actuated in variety of ways such as by electrical, hydraulic or mechanical methods. Once the ports are opened, formation fluids travel through the ports and a sample of the formation fluids is collected within the sampling chamber of the sampling tool. After the sample has been collected, the sampling tool may be withdrawn from the wellbore so that the formation fluid sample may be analyzed.

In many situations it has been found that multiple samples are needed in many situations. Also, it has been determined that as the fluid sample is retrieved to the surface, the temperature of the fluid sample decreases causing shrinkage of the fluid sample and a reduction in the pressure of the fluid sample. These changes can cause the fluid sample to approach or reach saturation pressure creating the possibility of asphaltene deposition and flashing of entrained gasses present in the fluid sample. Once such a process occurs, the resulting fluid sample is no longer representative of the fluid conditions present in the formation.

Accordingly, fluid samplers have been developed with the capacity to obtain and store multiple samples and with the capacity to maintain the samples at wellbore pressure during withdrawal from the wellbore. For example, samplers marketed by Halliburton Energy Services, Inc. under the trademark Armada® and the samplers disclosed in the Halliburton Energy Services, Inc.'s. U.S. Pat. Nos. 7,472,589; 7,596,995; 7,874,206 and 7,966,876 are capable of obtaining multiple samples and utilize high pressure inert gas nitrogen containers to maintain the samples as wellbore pressures during recovery to the wellhead. The above listed Halliburton patents are incorporated herein by reference for all purposes.

While these prior art samplers provide excellent sampling there are situations where these samplers are used in highly pressure, high temperature and corrosive well environments. Accordingly, the sample containers and nitrogen bottles in samplers used in these environments comprising a variety of expensive and exotic materials selected not to react with or contaminate the samples.

To fit in the wellbore and provide an adequate capacity of the samples and supply of pressurizing gas, these sample containers and nitrogen bottles are made in a long and thin shape. Some containers and bottles are as long as about 15 feet which requires undesirable welding of these exotic materials that comprise these portions of the sampler.

The existing fluid samplers are passive, in that they do not have a capacity to communicate with the surface. There have been occasions when for whatever reason the sampler did not obtain a sufficient sample. Accordingly, there is a need for a smarter fluid sampler which can measure the sampling process and parameters of the resulting sample and communicate these measurements to a surface operator or an embedded processor to initiate additional processes to obtain a proper sample.

SUMMARY OF THE INVENTIONS

The present invention disclosed herein provides an improved single phase fluid sampling apparatus and a method for obtaining a fluid sample from a subterranean formation without the occurrence of phase change degradation of the fluid sample during the collection of the fluid sample or retrieval of the sampling apparatus from the wellbore. The sampling apparatus is capable of being suspended in the well from coil tubing, jointed tubing, a wireline, a slick line or the like.

In addition, the sampling apparatus and method of the present invention are capable of maintaining the integrity of the fluid sample during storage on the surface.

In one aspect the present invention is directed to an improved apparatus for obtaining a plurality of fluid samples in a subterranean well that includes a carrier, a plurality of sampling chambers and an inert gas pressure source.

In another aspect of the present inventions, the carrier has a plurality of chamber receiving slots with separate sampling chambers are disposed within the chamber receiving slots. In addition, a plurality of pressurized gas bottle receiving slots with separate pressurized gas bottles are disposed within bottle receiving slots.

In a further aspect of the present inventions, the sampling chambers and gas bottles comprise light weight non-metallic materials such as fiber reinforced composite. These fiber reinforced composite chambers and bottles and their component parts can be molded or formed by winding on a rotating mandrel. Fiber reinforced composite does not require welding and is inert and will not react with the sample.

In an even further aspect of the present inventions, one or more of the following conductors, transducers, power sources, communicators, data memory and processors can be included in the sampler assembly.

In an additional aspect of the present invention, one or more of the following conductors, transducers, power sources, communicators, data memory and processors are embedded in the composite materials comprising the various components of sampler assembly.

In a further aspect of the present inventions, the sampling assembly measures one or more of the temperature, pressure, volume, electrical conductivity, electrical resistance, radioactivity and composition of the sample contained in at least one of the plurality of sampling chambers.

In an additional aspect of the present inventions, the sampling assembly measures one or more of the temperature and pressure of the wellbore fluids external to the sampling assembly.

In an even further aspect of the present inventions, data relating to the sample and or well fluid is communicated from the sampling apparatus to the surface and or stored in the sampling assembly.

BRIEF DESCRIPTION OF THE DRAWINGS

The drawings are incorporated into and form a part of the specification to illustrate at least one embodiment and example of the present invention. Together with the written description, the drawings serve to explain the principles of the invention. The drawings are only for the purpose of illustrating at least one preferred example of at least one embodiment of the invention and are not to be construed as limiting the invention to only the illustrated and described example or examples. The various advantages and features of the various embodiments of the present invention will be apparent from a consideration of the drawings in which.

DETAILED DESCRIPTION

Figure 1:
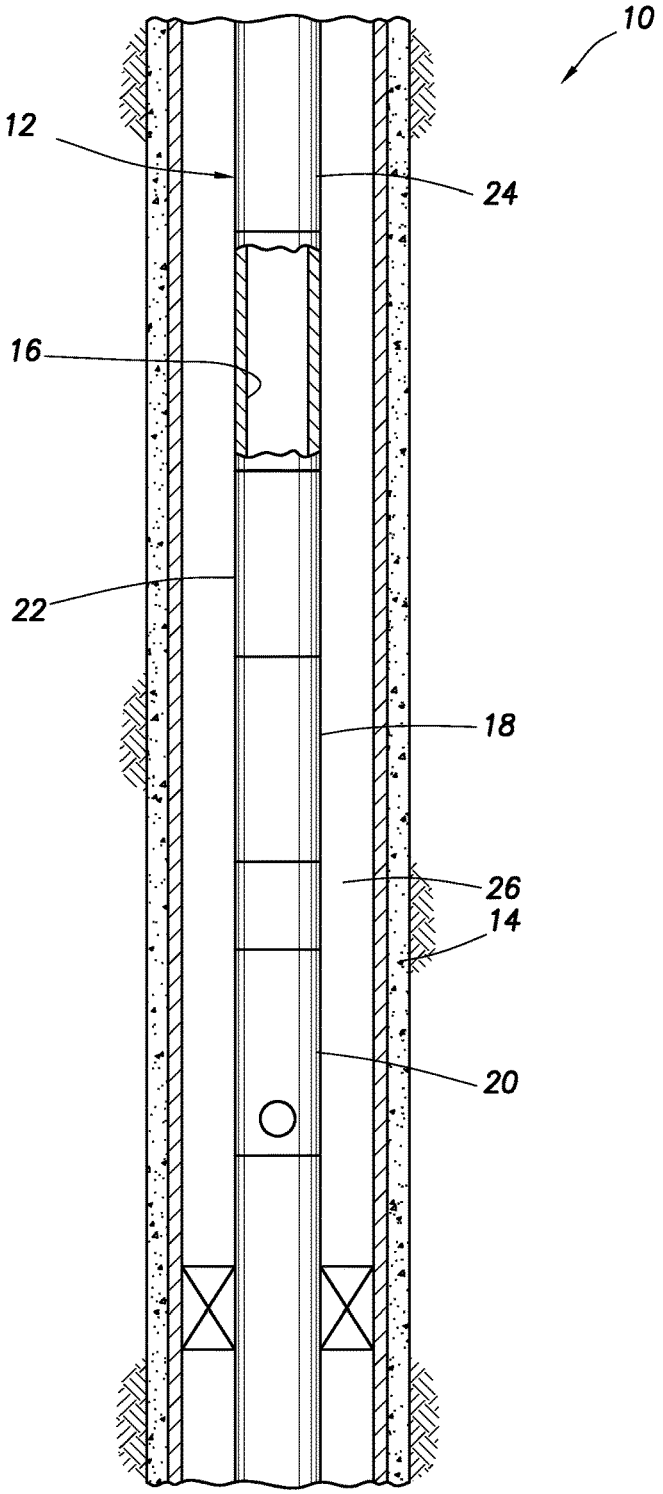
FIG. 1 is a schematic illustration of an embodiment of the fluid sampler system embodying principles of the present invention.

Referring initially to FIG. 1, therein is representatively illustrated a fluid sampler system 10 and associated methods which embody principles of the present invention. The embodiment illustrated in this figure is particularly adapted for connection to and suspension from a tubular member. A fluid sampler assembly 18 is connected in tubular string 12 by connection means, such as, threads at its upper end. In the embodiments (not illustrated) that are adapted to attached to wire or slick line equipment the attachment means comprises a coupling adapted to provide electrical connection to the wire or slick line.

A tubular string 12, such as a drill stem test string, is positioned in a wellbore 14. An internal flow passage 16 extends longitudinally through tubular string 12. Also, preferably included in tubular string 12 are a circulating valve 20, a tester valve 22 and a choke 24. Circulating valve 20, tester valve 22 and choke 24 may be of conventional design. It should be noted, however, by those skilled in the art that it is not necessary for tubular string 12 to include the specific combination or arrangement of equipment described herein. It is also not necessary for sampler 18 to be included in the tubular string 12 since, for example, sampler 18 could instead be conveyed through flow passage 16 using a wireline, slickline, coiled tubing, downhole robot or the like. When using the wire and slick line equipment the sampler 18 can be connected to communicate to the well head through the wire and slick lines. Although wellbore 14 is depicted as being cased and cemented, it could alternatively be uncased or open hole.

In a formation testing operation, tester valve 22 is used to selectively permit and prevent flow through passage 16. Circulating valve 20 is used to selectively permit and prevent flow between passage 16 and an annulus 26 formed radially between tubular string 12 and wellbore 14. Choke 24 is used to selectively restrict flow through tubular string 12. Each of valves 20, 22 and choke 24 may be operated by manipulating pressure in annulus 26 from the surface, or any of them could be operated by other methods if desired.

Choke 24 may be actuated to restrict flow through passage 16 to minimize wellbore storage effects due to the large volume in tubular string 12 above sampler 18. When choke 24 restricts flow through passage 16, a pressure differential is created in passage 16, thereby maintaining pressure in passage 16 at sampler 18 and reducing the drawdown effect of opening tester valve 22. In this manner, by restricting flow through choke 24 at the time a fluid sample is taken in sampler assembly 18, the fluid sample may be prevented from going below its bubble point, i.e., the pressure below which a gas phase begins to form in a fluid phase. Circulating valve 20 permits hydrocarbons in tubular string 12 to be circulated out prior to retrieving tubular string 12.

Even though FIG. 1 depicts a vertical well, it should be noted by one skilled in the art that the fluid sampler of the present invention is equally well-suited for use in deviated wells, inclined wells or horizontal wells. As such, the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure.

Figure 2:
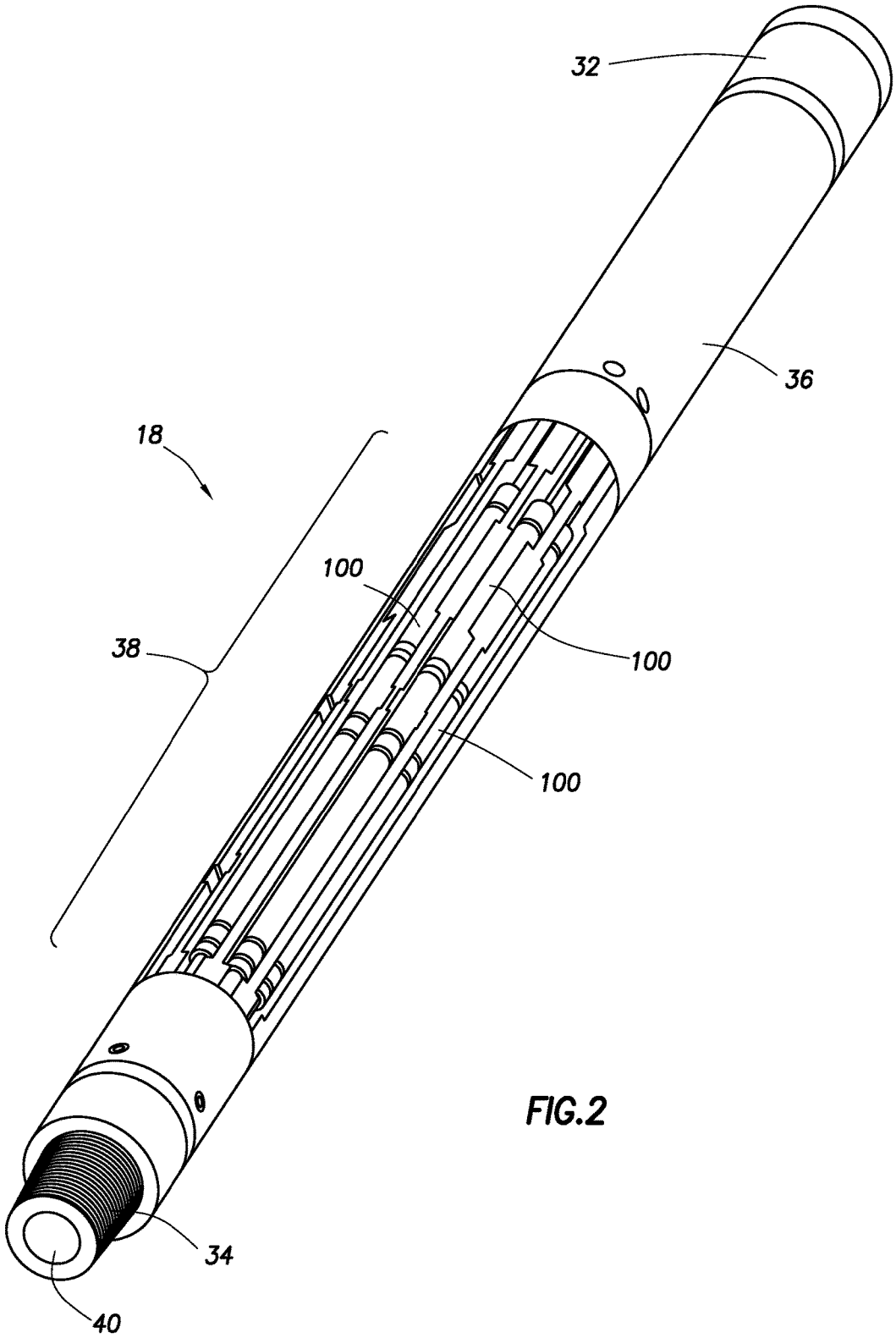
FIG. 2 is a perspective view of the sampler system embodying principles of the present invention.

In FIG. 2, a sampler assembly 18 includes an upper connector 32 and lower connector 34 for coupling in a tubing string. An actuator section 36 is positioned below the upper connector and axially below the actuator section is a sample carrier section 38. The sampler assembly includes a central passageway 40 which provides a smooth bore through fluid sampler. As illustrated a plurality of fluid sampling chambers 100 are mounted in slots in the carrier section 38.

The operation and detail structure of the actuator section 36 are described in U.S. Pat. No. 7,966,876, which is incorporated herein by reference for all purposes. In general terms the actuator sections contains a plurality of passageways and valves that in response to an external input (such as, electrical, electromagnetic signal or pressure change) will connect an inlet passageway in the upper end of one or more of the sampling chambers 100 to the fluid in the wellbore. After the well fluid has been collected in the chambers 100 the actuator will disconnect the chambers 100 from the wellbore trapping the sample in the chamber.

In FIGS. 3A-3F, a fluid sampling chamber that embodies principles of the present invention is representatively illustrated and generally designated by reference numeral 100. The upper portion 102 of the sampling chamber 100 (See FIG. 3A) is provided with seals 104 on one end for mounting in the sample carrier section 38. The other end of upper portion is threaded into a nipple 108. The nipple 108 is connected to an elongated tubular section 109 by threads 111.

A passage 110 extends through the upper portion 102 and is mounted in the communication with an internal fluid passageway 112 in the nipple 108. A normally closed sample collecting solenoid valve 116 is opened by a command signal conducted form the surface or an internal controller in the sampler assembly 18. When the fluid sampling operation is initiated using actuator 36, fluid enters passage 112 and passes into chamber 114 via valve 116. Valve 116 permits fluid to flow from passages and 112 110 into sample chamber 114, but prevents fluid from escaping from sample chamber 114.

Figure 3A:
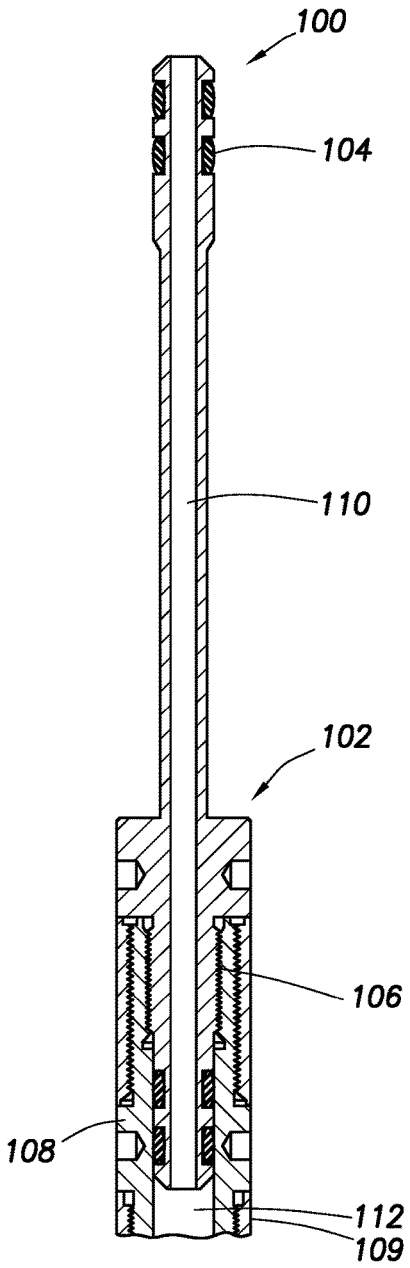
FIG. 3 *a-f* are cross-sectional views of successive axial portions of a sampling section of a sampler system embodying principles of the present invention.
Figure 3B:
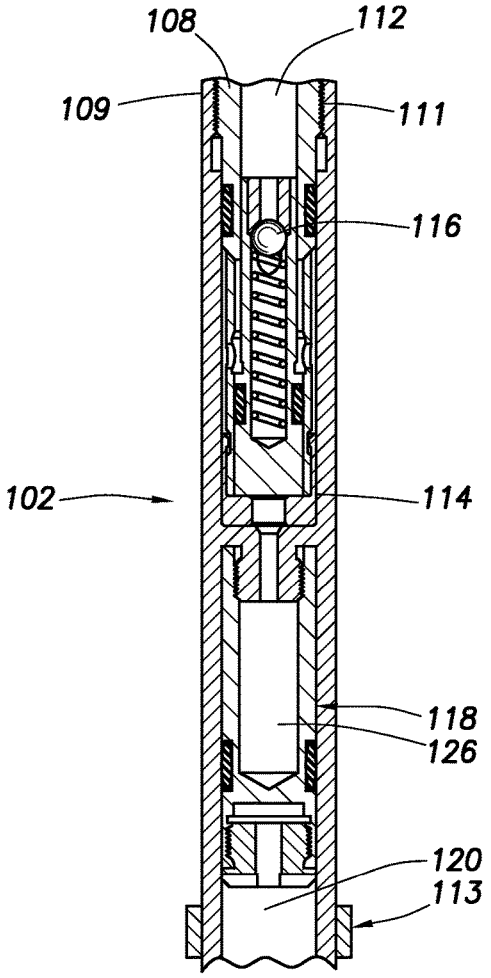

Turning to FIG. 3B, a debris trap piston 118 is mounted for reciprocal movement in tubular section 109 and separates sample chamber 114 from meter fluid chamber 120. Debris trap piston 118 is illustrated having an internal debris chamber 126. The seals in piston 118 isolate sample chamber 114 from a meter fluid chamber 120. When a fluid sample is received in sample chamber 114, piston 118 is displaced downwardly. The initially received fluid is typically laden with debris, or is a type of fluid (such as mud) which it is not desired to sample. Debris chamber 126 thus permits this initially received fluid to be isolated by a check valve (not illustrated) from the fluid that is later received in sample chamber 114. The check valve can be a spring loaded plunger or flapper valve.

As will be described herein in more detail, sensors and conductors are formed or mounted in or embedded in the wall of tubular section 109 to sense the position of the piston 118. By sensing the position of the piston 118 the volume of the sample collected can be determined. In addition pressure and temperature transducers are mounted or embedded in the wall of tubular section 109 to provide readings of the pressure and temperature of the sample and of the wellbore fluids during and after sample collection. Alternatively, external transducers and data coupling 113 can be mounted on the exterior of tubular section 109. The volume, pressure and temperature measurement data can be recorded and transmitted to the surface. In addition, other transducers for measuring other parameters, such as, electrical conductivity, electrical resistance, radioactivity and composition can be provided (mounted or formed) in the walls of the assembly 18.

Figure 3C:
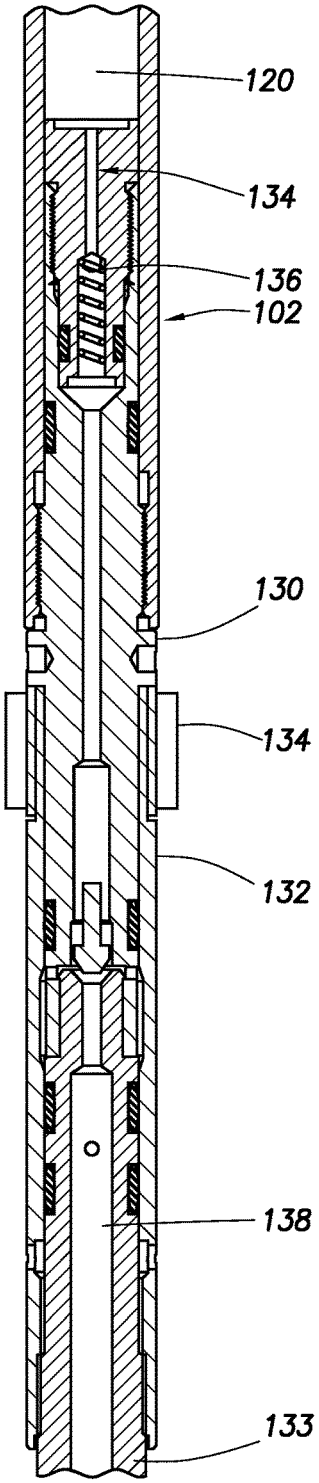

In FIGS. 3C and D, the lower end of the tubular section 109 is illustrated threaded onto one end of a coupling 130. A short tubular section 132 is threaded onto the other end of coupling 130 and an additional coupling 133 is threaded into the opposite end of tubular section 132. The other end of coupling 133 is threaded into a tubular member 142 and a third coupling 144 is connected to the opposite end of tubular member 142.

As will be described, couplings 130 and 133 provide space for locating the electronics and processors associated with the pressure, temperature, volume, and other sample measuring transducers and sensors and for the data recording and transmission apparatus. An external power and data coupling 134 is provided for supplying power and control instructions to the fluid sampling chamber and for receiving data therefrom. In the wire line and slick line embodiments, connections to this surface can be made through coupling 134.

The meter fluid chamber 120 initially contains a metering fluid, such as a hydraulic fluid, silicone oil or the like. A flow restrictor 135 and a check valve 136 located in nipple 130 controls flow between chamber 120 and a meter fluid receiving chamber 138 formed in tubular member 142. A piston assembly 140 reciprocates in tubular member 142 and separates chamber 138 from an atmospheric chamber 148. Chamber 148 initially contains a gas at a relatively low pressure such as air at atmospheric pressure. By selecting a flow restrictor of appropriate size, the rate of collection of the sample can be controlled to insure sample quality.

Figure 3D:
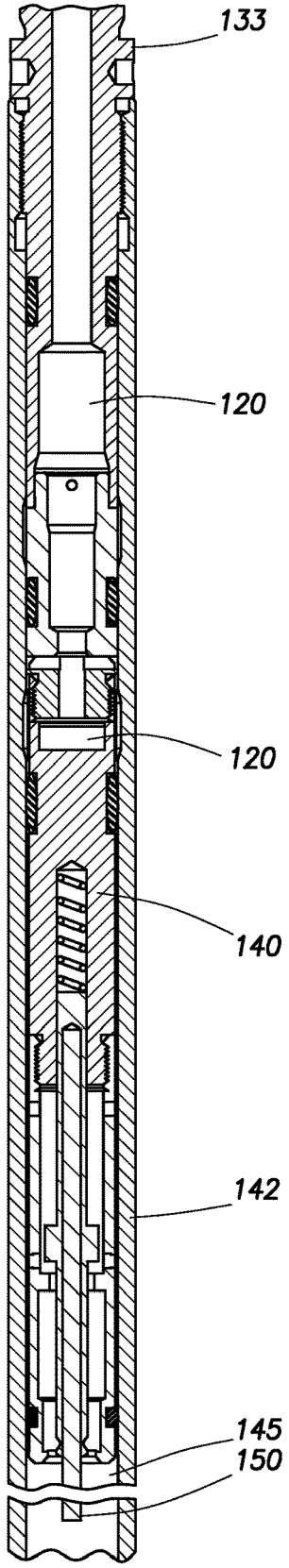
Figure 3E:
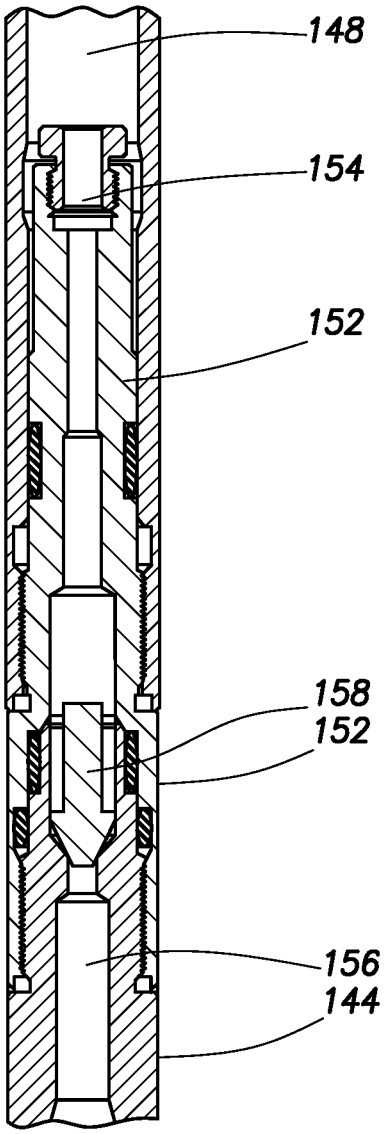
Figure 3F:
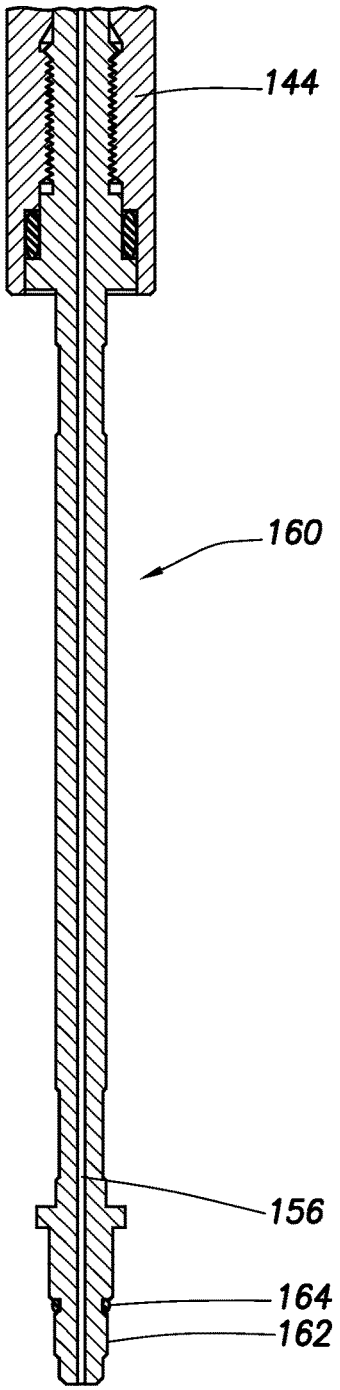

FIG. 3D illustrates a piston assembly 140 mounted in chamber 138 to separate chamber 138 from atmospheric chamber 148. Chamber 148 initially contains gases at a relatively low pressure, such as, air at atmospheric pressure. As metering fluid enters chamber 120, piston 140 is forced to move downward away from the flow restrictor 134 and check valve 136. As the piston assembly 140 moves down, the gases in chamber 148 are compressed.

A rod 150 is carried by piston 140 and upon downward movement of the piston, the rod contacts a manifold 152 connected to coupling 144 to indicate that the sampling process is completed and to open gas supply valve 154. (See FIG. 3E.) A check valve 158 permits fluid flow from passage 156 into chamber 148, but prevents fluid flow from chamber 148 to passage 156. Lower section 160 has a threaded connector 162 with annular seals for connecting to the passageway 156 in nipple 144 and connecting passageway 146 in the sample carrier section 38 connected to a supply of pressurized gas. According to the present invention a pressure transducer is included in nipple 144 for measuring the pressure of the gas in the supply.

Figure 4:
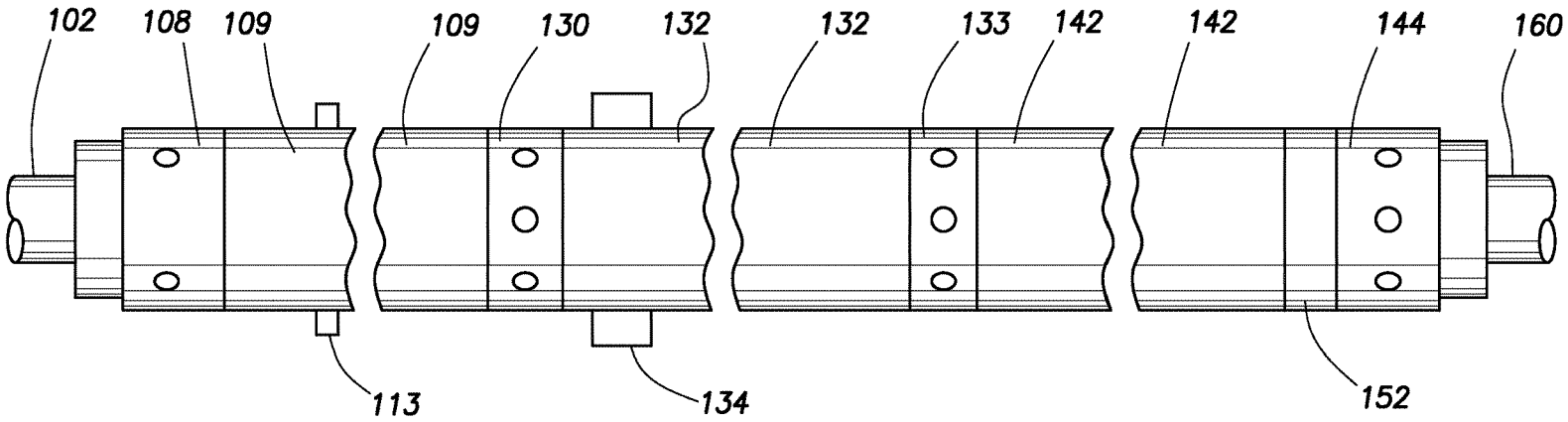
FIG. 4 is a schematic of the components forming the sampling section.

By referring to FIGS. 4 and 5, the construction of the fluid sampling chamber 100 will be described. In general, the sampling chamber 100 comprises a plurality of tubular members connected together by unions. The entire sampling chamber 100 and its external component parts 102, 108, 109, 113, 130, 132, 133, 134, 142, 144, 152, and 160 are molded, wrapped or otherwise formed substantially from materials that do not react with well fluids. In one embodiment the tubular sections could be substantially formed from materials comprising filament wound composite materials, wet wrapped composite materials, engineering grade plastics, including resins. In other embodiments, the materials complies molded resins with or without structural filaments added. It is known in the industry to use non-metallic plastic materials to form tubular sections of pipe, tubing and casing with internally threaded ends formed on these materials.

The ends 102 and 160, the nipples 108, 130,132, and 144 and the mandrel 152 can be made from composite materials by molding or by filament winding with the external threads and other external and internal structures machined thereon. Likewise the internal pistons, valves and the like comprising the sampling chamber 100 could be formed by composite material by bonding or filament winding. Contamination of sample by corrosion will be eliminated with the use of non-metallic materials.

According to other features of the present invention, transducers and conductors are embedded in the walls of the components of the sampling chamber 100. In FIG. 5 a cross section of the tubular section 109 formed from composite materials is illustrated. One or more conductors of 109*a* are embedded in the wall of tubular section 109. The conductors can comprise metallic wire or carbon fibers in the form of a conductor (shown in FIG. 5) or conductive layer (not shown) integrally formed during molding or winding. In one example embodiment, a metallic layer of mu-metal is embedded to provide magnetic shielding and form a conductive path.

Figure 5:
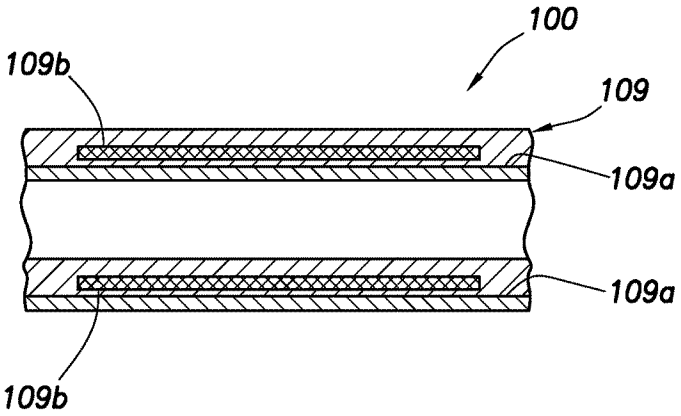
FIG. 5 is an enlarged cross-sectional view of a portion of the sampling section.
Figure 6:
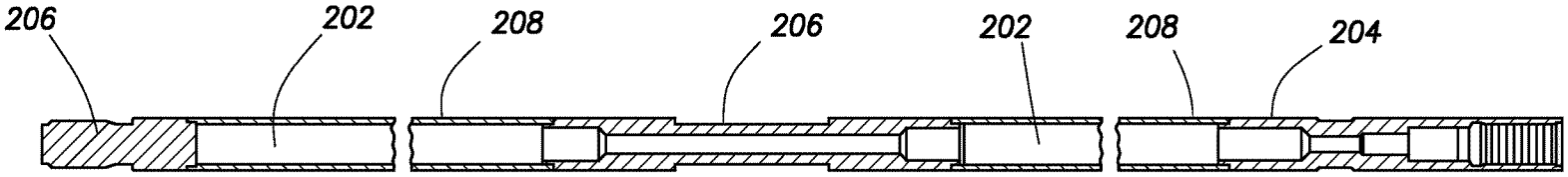
FIG. 6 is cross-sectional views of the inert gas bottle of the present invention of the present invention.

In addition transducers 109*b* can be molded into the wall of the sampling chamber components such as tubular section 109 as illustrated in FIG. 5. The conductor and transducer mounting concepts described and illustrated by example to section 109 would be utilized in the formation of the other components of the sampling chamber 100.

As mentioned above, one or more of the sampling chambers 100 (in this embodiment nine collection chambers 100 are present) are installed within exteriorly disposed chamber receiving slots of the carrier section 38. An upper seal bore (not show) is provided in carrier 38 for receiving the upper portion of sampling chamber 102 and a lower seal bore (not shown) is provided for receiving the lower portion of sampling chamber 160.

In addition to the multiple sampling chambers 100 installed within carrier 38 an equal number of pressure sources 200 are present. Each of the passages 156 in lower sections 160 is in fluid communication with chambers 202 of pressure a sources 200 through passageways in carrier section 38 (not illustrated). An example of the pressure source 200 is illustrated in FIG. 5. The plurality of pressure sources 200 are mounted in a carrier similar to that illustrated in FIG. 2. In this manner a pressure source 200 is present to act against a piston 140 each sampling chamber 100. The nitrogen piston 140 is used to maintain the samples at pressure during recovery. This pressure allows monophasic sampling and ensures that the fluid is an accurate representation of the well conditions. Preferably, compressed nitrogen at between about 7,000 psi and 12,000 psi is used to precharge chambers 202, but other fluids or combinations of fluids and/or other pressures both higher and lower could be used, if desired.

The pressure source 200 embodiment illustrated in FIG. 5 comprises upper 204 and lower 206 end caps and a central passageway 206. Cylindrical sections 208 join the end caps to the central passageway to form chambers 202. In another embodiment (not shown), the pressure source could be formed in a seamless manner, such as by molding or by filament winding. In this manner a unitary walled pressure source could be formed.

According to a particular feature of the present invention the pressure source consists of materials that are nonmagnetic. According to a further embodiment the pressure source consists of non-metallic materials. In an additional embodiment, the pressure source substantially comprises engineering grade plastics. In another embodiment, the pressure source substantially comprises filament wound composite material. In a further embodiment, the pressure source substantially comprises wet wrapped composite material.

While compositions and methods are described in terms of "comprising," "containing," or "including" various components or steps, the compositions and methods also can "consist essentially of" or "consist of" the various components and steps. As used herein, the words "comprise," "have," "include," and all grammatical variations thereof are each intended to have an open, non-limiting meaning that does not exclude additional elements or steps.

Therefore, the present inventions are well adapted to carry out the objects and attain the ends and advantages mentioned as well as those which are inherent therein. While the invention has been depicted, described, and is defined by reference to exemplary embodiments of the inventions, such a reference does not imply a limitation on the inventions, and no such limitation is to be inferred. The inventions are capable of considerable modification, alteration, and equivalents in form and function, as will occur to those ordinarily skilled in the pertinent arts and having the benefit of this disclosure. The depicted and described embodiments of the inventions are exemplary only, and are not exhaustive of the scope of the inventions. Consequently, the inventions are intended to be limited only by the spirit and scope of the appended claims, giving full cognizance to equivalents in all respects.

Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

The invention claimed is:

1. A sample container for use in capturing a fluid sample from fluids located in a well at a subterranean location and for removing the fluid sample from the well, the sample container comprising:
   - an elongated tubular shaped housing defining an elongated fluid chamber therein, the elongated fluid chamber comprising:
     - a vessel defining a chamber therein for receiving a pressurized gas; and
     - a valve between the chamber of the vessel and the chamber of the housing, the valve being selectively operable to release at least some of the pressurized gas from the chamber of the vessel into the chamber of the housing,
   - wherein: the housing comprises a substantially non-metallic tubular member; a port for entry of a fluid sample into the elongated fluid chamber; and the elongated fluid chamber is configured to maintain the fluid sample therein at a predetermined pressure.

2. The sample container of claim 1, further comprising a substantially non-metallic piston mounted to longitudinally reciprocate in the elongated fluid chamber and divide the elongated fluid chamber into portions.

3. The sample container of claim 2, further comprising a sensor for sensing the position of the piston in the elongated fluid chamber.

4. The sample container of claim 3, wherein the sensor for sensing the position of the piston is at least partially embedded in the substantially non-metallic tubular member.

5. The sample container of claim 1, wherein the elongated fluid chamber has a circular transverse cross-sectional shape.

6. The sample container of claim 1, wherein the substantially non-metallic tubular member substantially comprises filament wound composite material or engineering grade plastic.

7. The sample container of claim 1, further comprising a transducer associated with the elongated fluid chamber to measure the pressure of the fluid sample contained in the elongated fluid chamber.

8. The sample container of claim 1, further comprising a transducer associated with the elongated fluid chamber to measure the temperature of the fluid sample contained in the elongated fluid chamber.

9. The sample container of claim 1, further comprising a transducer associated with the elongated fluid chamber to measure the volume of the fluid sample contained in the fluid chamber.

10. The sample container of claim 1, further comprising a transducer associated with the elongated fluid chamber to measure the volume of the fluid sample contained in the elongated fluid chamber.

11. The sample container of claim 1, further comprising a transducer associated with the elongated fluid chamber to measure the electrical conductivity of the fluid sample contained in the elongated fluid chamber.

12. The sample container of claim 1, further comprising a transducer associated with the elongated fluid chamber to measure the electrical resistance of the fluid sample contained in the elongated fluid chamber.

13. The sample container of claim 1, further comprising a transducer associated with the elongated fluid chamber to measure the radioactivity of the fluid sample contained in the elongated fluid chamber.

14. The sample container of claim 1, further comprising a transducer positioned to measure the temperature of the fluids in the well.

15. The sample container of claim 1, further comprising a transducer positioned to measure the pressure of the fluids in the well.

16. The sample container of claim 1, further comprising a data conductor or an electricity conductor at least partially embedded in the tubular member.

17. The sample container of claim 16, wherein the sample container comprises the electricity conductor, and wherein the electricity conductor comprises metallic material.

18. The sample container of claim 16, wherein the sample container comprises the electricity conductor, and the electricity conductor comprises carbon material.

19. The sample container of claim 16, wherein the sample container comprises the data conductor.

20. The sample container of claim 1, further comprising mu-metal at least partially embedded in the tubular member.

21. The sample container of claim 1, further comprising a coupling configured to provide electrical connection to a wire line.

22. The sample container of claim 1, further comprising a coupling configured to provide electrical connection to a slick line.

23. A sample container for use in capturing a fluid sample from fluids located in a well at a subterranean location and for removing the fluid sample from the well, the sample container comprising:

a housing defining an elongated chamber therein for receiving the fluid sample from the well;

a port for entry of a fluid sample into the chamber of the housing;

an elongated vessel defining a chamber therein for receiving a pressurized gas, the vessel comprising a substantially non-metallic tubular member; and a valve between the chamber of the vessel and the chamber of the housing, the valve being selectively operable to release at least some of the pressurized gas from the chamber of the vessel into the chamber of the housing.

24. The sample container of claim 23, wherein the tubular member of the vessel comprises filament wound composite material.

25. The sample container of claim 23, wherein the tubular member of the vessel substantially comprises wet wrapped composite material.

26. The sample container of claim 23, wherein the tubular member of the vessel substantially comprises engineering grade plastic.

27. A sampling assembly for use in capturing a fluid sample from fluids located in a well at a subterranean location and for removing the fluid sample from the well, the sampling assembly comprising:

a carrier having a plurality of openings therein; and a corresponding plurality of the sample containers, each of the sample containers being mounted in one of the openings in the carrier and comprising:

an elongated tubular shaped housing defining an elongated fluid chamber therein, the elongated fluid chamber comprising:

a vessel defining a chamber therein for receiving a pressurized gas; and a valve between the chamber of the vessel and the chamber of the housing, the valve being selectively operable to release at least some of the pressurized gas from the chamber of the vessel into the chamber of the housing, wherein: the housing comprises a substantially non-metallic tubular member; a port for entry of a fluid sample into the elongated fluid chamber; and the elongated fluid chamber is configured to maintain the fluid sample therein at a predetermined pressure.

* * * * *